US007089692B2

(12) United States Patent
Strait

(10) Patent No.: US 7,089,692 B2
(45) Date of Patent: Aug. 15, 2006

(54) SLIP HITCH FOR A SNOW PLOW

(76) Inventor: Randy W. Strait, 22763 S. Center Rd., Frankfort, IL (US) 60423

( * ) Notice: Subject to any disclaimer, the term of this patent is extended or adjusted under 35 U.S.C. 154(b) by 388 days.

(21) Appl. No.: 10/613,313

(22) Filed: Jul. 7, 2003

(65) Prior Publication Data

US 2005/0005479 A1 Jan. 13, 2005

(51) Int. Cl.
*E01H 5/04* (2006.01)

(52) U.S. Cl. ..... 37/232; 37/231; 172/261

(58) Field of Classification Search ..... 37/231, 37/232, 266, 264, 468; 280/186; 172/261, 172/817, 272, 273, 677, 679, 680; 414/723
See application file for complete search history.

(56) References Cited

U.S. PATENT DOCUMENTS

| | | | | | |
|---|---|---|---|---|---|
| 2,420,591 | A * | 5/1947 | Frame et al. | 37/232 |
| 3,250,026 | A * | 5/1966 | Jocher et al. | 37/232 |
| 3,432,949 | A * | 3/1969 | Glesmann | 37/231 |
| 3,760,883 | A * | 9/1973 | Birk | 172/273 |
| 3,845,577 | A * | 11/1974 | Naymik | 37/231 |
| 4,068,959 | A * | 1/1978 | Pemberton | 403/15 |
| 4,222,442 | A * | 9/1980 | Westendorf et al. | 172/273 |
| 4,243,356 | A * | 1/1981 | Takojima | 414/723 |
| 4,255,878 | A * | 3/1981 | Mahler et al. | 37/232 |
| 4,307,523 | A * | 12/1981 | Reissinger et al. | 37/233 |
| 4,528,762 | A * | 7/1985 | Sarka et al. | 37/236 |
| 5,529,419 | A * | 6/1996 | Gebauer | 403/24 |
| 5,655,318 | A * | 8/1997 | Daniels | 37/231 |
| 5,779,429 | A * | 7/1998 | Poole | 414/723 |
| 5,860,230 | A * | 1/1999 | Daniels | 37/232 |
| 6,168,369 | B1 * | 1/2001 | Bright et al. | 414/724 |
| 6,354,025 | B1 * | 3/2002 | Kirchell | 37/232 |
| 6,988,560 | B1 * | 1/2006 | Bay | 172/272 |

* cited by examiner

*Primary Examiner*—Thomas B. Will
*Assistant Examiner*—Toni Newville
(74) *Attorney, Agent, or Firm*—Davis Chin

(57) ABSTRACT

A slip hitch connection to a drive vehicle for a snow plow comprises an elongated flat planar member that can be hooked on to a connecting lug of the drive vehicle, the flat planar member being mounted on the snow plow frame for reciprocal movement in each of a pair of spaced apart coupling assemblies secured to the snow plow frame for connecting the snow plow to the drive vehicle. Each of the elongated flat planar members have an upper and lower elongated guide slot in which guide bolts that move up and down as the snow plow itself is moved up and down are received to enable the guide bolts and snow plow to which they are connected make limited reciprocal movement up and down while hooked up to the drive vehicle and being pushed forward during a snow plowing operation. This enables the snow plow to move rearwardly and upwardly enough to clear an object hit by the leading edge of the snow plow on the ground and then to reciprocate forwardly and downwardly to its original position after passing over the obstacle.

6 Claims, 5 Drawing Sheets

SLIP HITCH FOR A SNOW PLOW

FIELD OF THE INVENTION

This invention relates to the field of hitches or coupling assemblies that connect a snow plow or other comparable item to a drive vehicle, and in particular to one in which the snow plow can momentarily release or slip over a blocking object it encounters as it is moved along the ground during its snow plowing operation, and then return to its original working position after it has passed over the blocking object. It also relates to a slip hitch for a snow plow or other comparable item that enables the snow plow or other comparable item to adjust to the incline and decline of the surface being plowed or scraped.

BACKGROUND OF THE INVENTION

The typical prior art hitches or coupling assemblies for snow plows that connect them to a drive vehicle have a rigid non-release mechanism. When a blocking object is encountered on the ground, the only way for such prior art connections of a snow plow to a drive vehicle to get over the obstacle is for the operator to manually operate the lifting and lowering mechanism of the coupling assembly to raise the snow plow that way, then drive past the obstacle and then manually operate the lifting and lowering mechanism to lower the snow plow back on to the ground.

SUMMARY OF THE INVENTION

The hitch or coupling assembly in accordance with the present invention includes an elongated slip hitch operating member that hooks on to the connecting lug of the drive vehicle coupling apparatus, in which the slip hitch operating member has one or more elongated guide slots to receive corresponding guide rods or bolts that are connected to members that are in turn connected to the snow plow. When the snow plow encounters an obstacle on the ground, the lower edge of the snow plow is urged rearwardly which puts rearward pressure on the guide rods in the guide slots of the slip hitch operating member causing them to ride upwardly in the guide slots. The lower edge of the snow plow is thus able to move rearwardly and upwardly as the guide rods move upwardly in the guide slots until the snow plow is able to clear the obstacle, after which the guide rods slide back down in the guide slots as the snow plow is lowered by gravity back to its original operating position in contact with the ground.

DESCRIPTION OF PREFERRED EMBODIMENT

Figure 1:
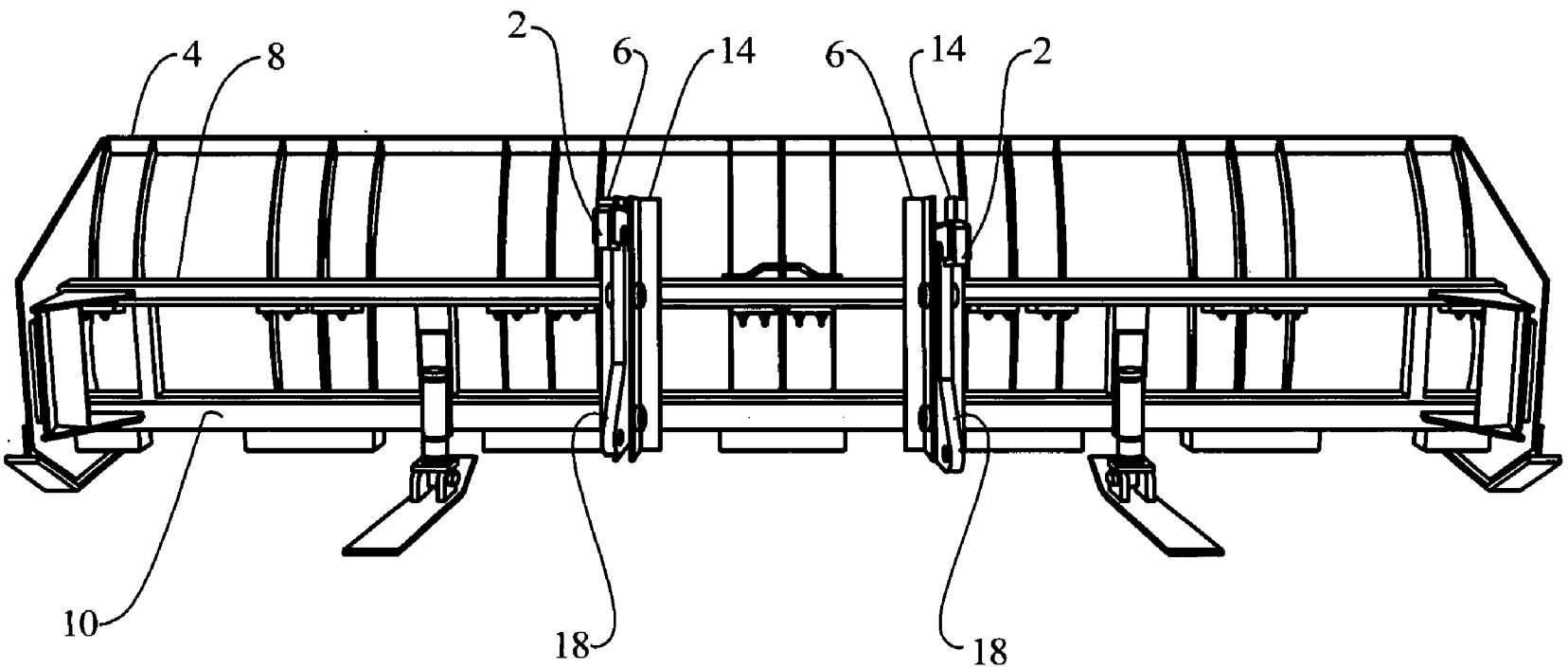
FIG. 1 is an elevation view of the rear of a snow plow having a pair of spaced apart slip hitch connecting members for connection to a drive vehicle.
Figure 2:
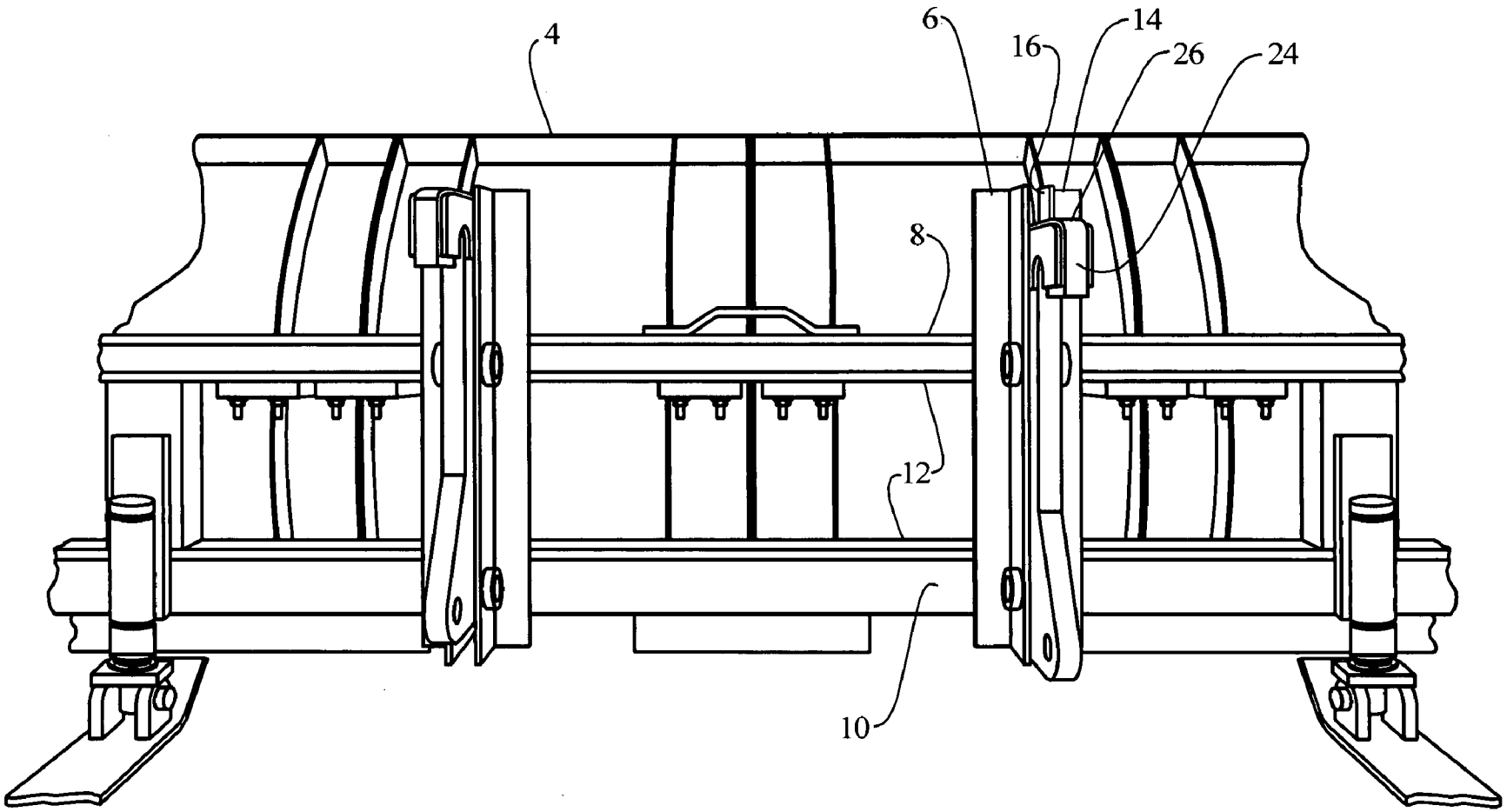
FIG. 2 is an enlarged elevation view of the mid-portion of the rear of the snow plow seen in FIG. 1 to better illustrate the pair of spaced apart slip hitch connecting members.
Figure 3:
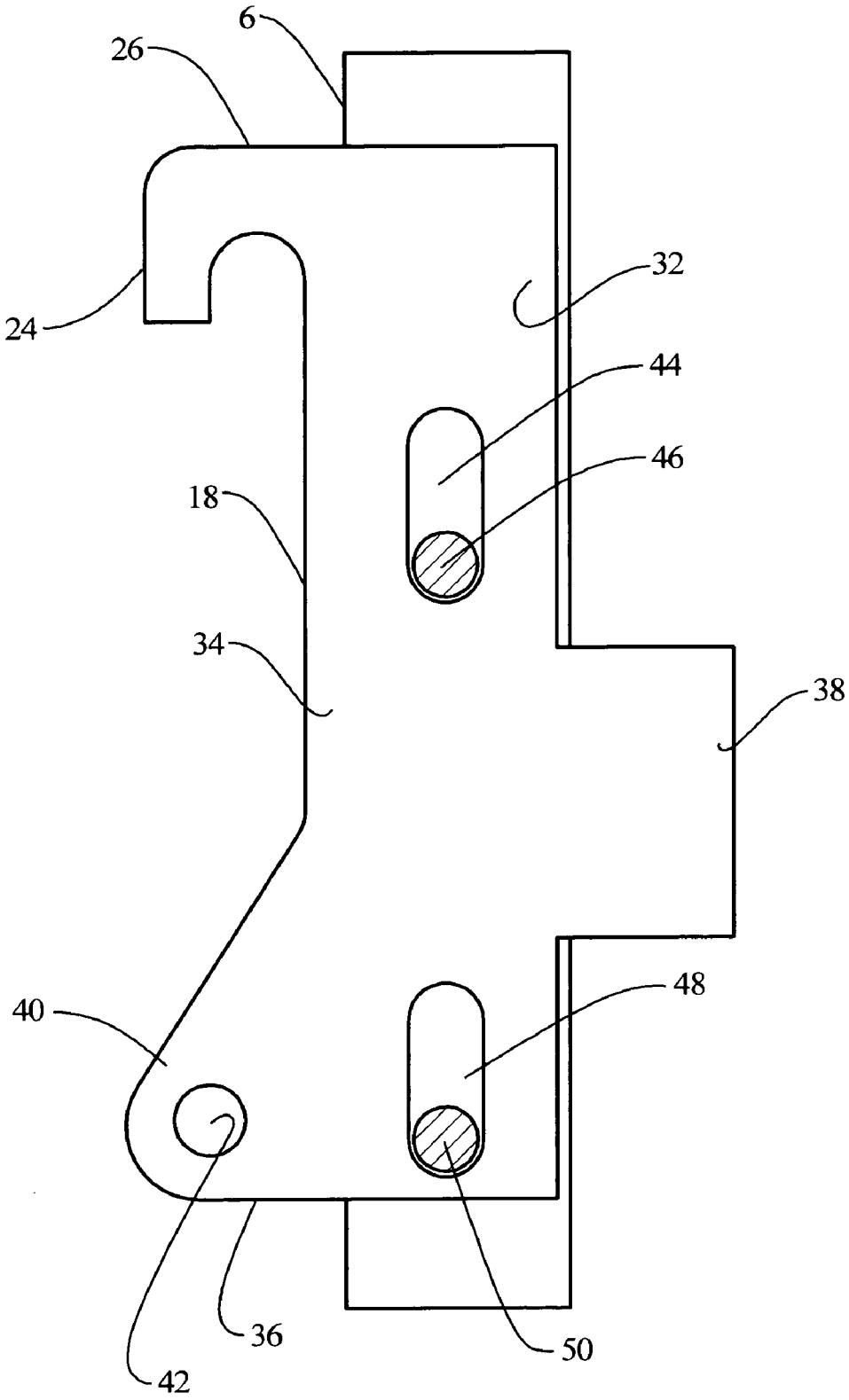
FIG. 3 is an elevation view of the elongated slip hitch member mounted for limited reciprocal movement relative to the vertical mounting bars between which it is positioned, one of the vertical mounting bars being broken away to better illustrate the slip hitch member, and showing upper and lower guide rods in section in their respective guide slots of the slip hitch member.
Figure 4:
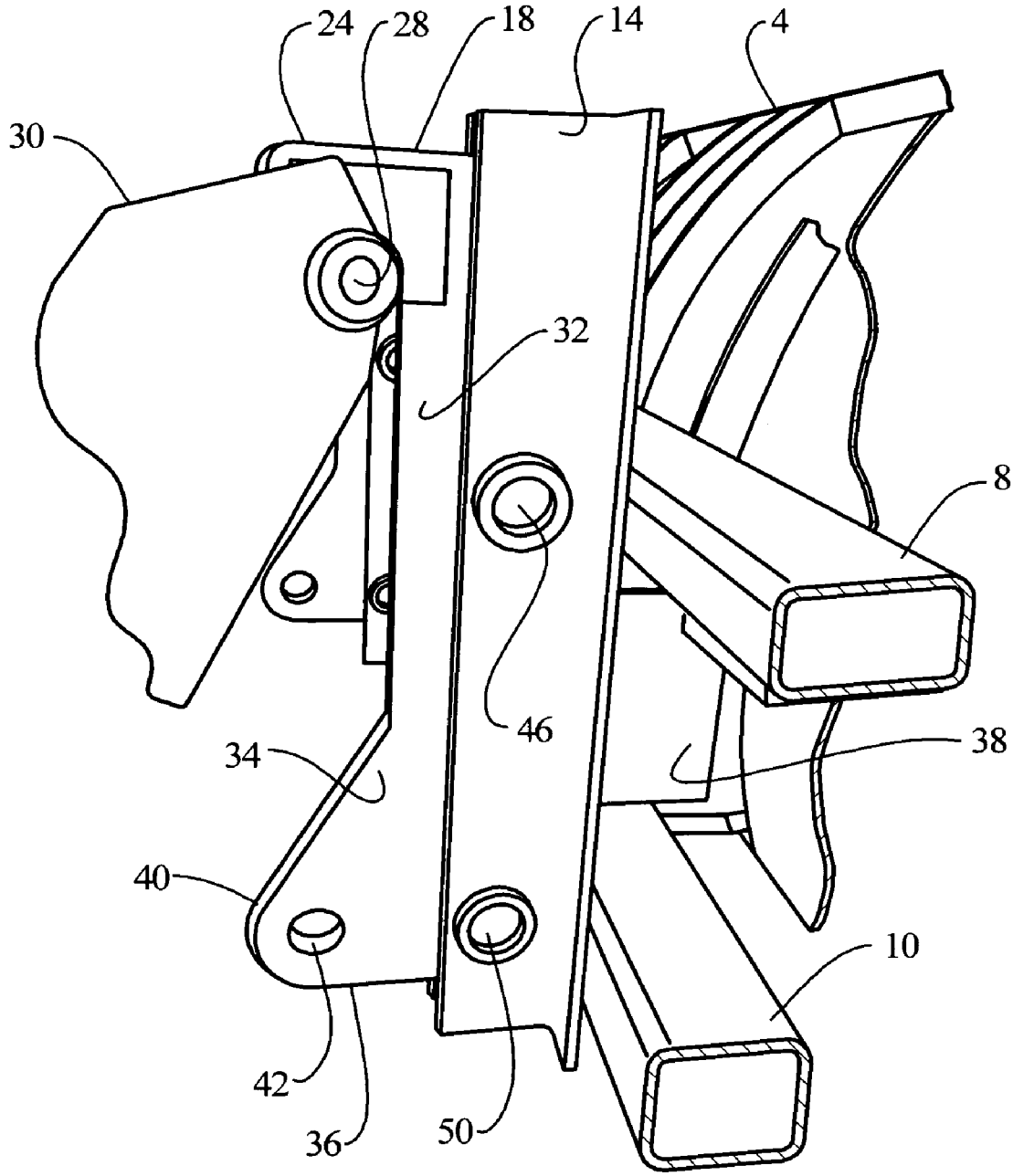
FIG. 4 is an elevation view of a portion of the side of a snow plow having slip hitch connecting members and also of a portion of the side of a connecting member of a drive vehicle in position to connect to the slip hitch connecting members.
Figure 5:
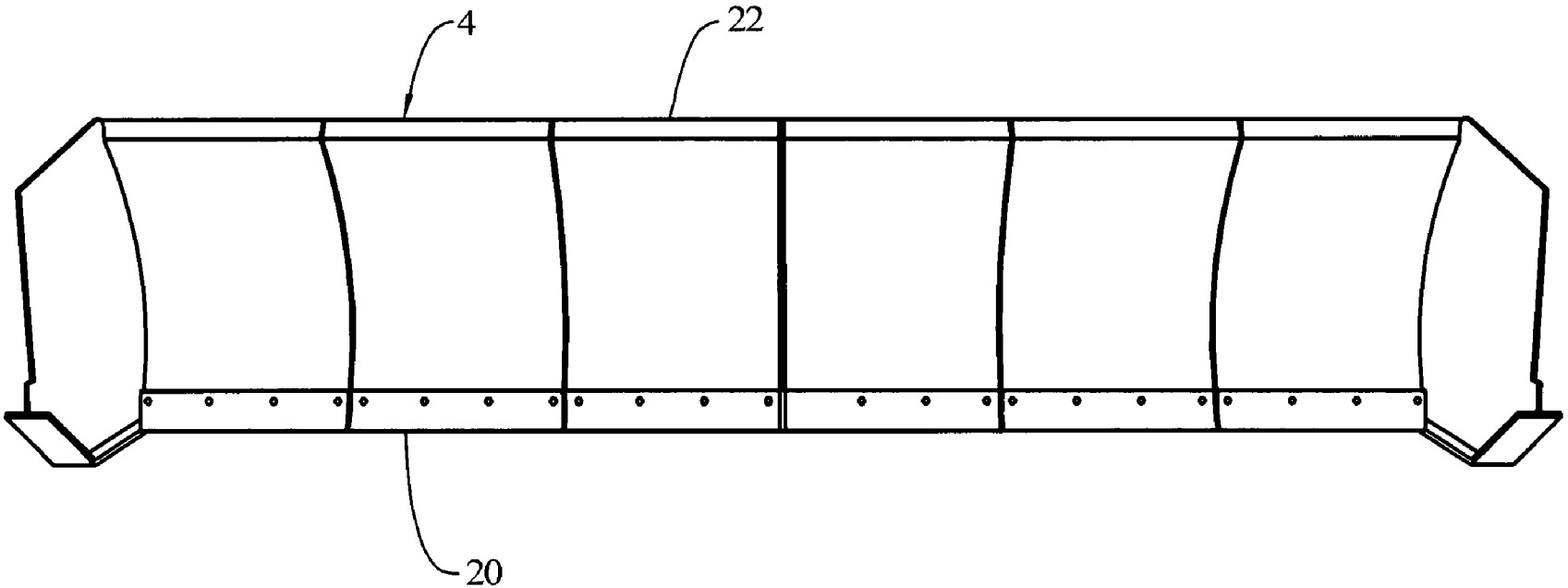
FIG. 5 is an elevation view of the front of the snow plow seen in FIG. 1.

A slip hitch connecting assembly in accordance with the present invention includes a pair of spaced apart vertical connecting members 2 welded or otherwise secured to the back of a snow plow 4 or other item of equipment that is hitched to a drive vehicle for performing a work function on the surface of the ground as it is moved forward by the drive vehicle. The snow plow 4 shown and described herein has a sectioned moldboard which is the subject of a separate co-pending patent application Ser. No. 10/057,269 filed in the United States Patent and Trademark Office Jan. 28, 2002 by the same inventor, but the slip hitch connecting assembly in accordance with this invention can be used with other snow plows and similar equipment as well.

Each vertical connecting member 2 is identical so only one need be described in detail. Each includes a first upright bar 6 welded or otherwise secured to the upper horizontal frame bar 8 and lower horizontal frame bar 10 of the snow plow frame 12 which extend across the rear of the snow plow 4. Each vertical connecting member 2 also includes a second upright bar 14 which is also welded or otherwise secured to the horizontal frame bars 8 and 10 at a location slightly spaced apart horizontally from the first upright bar 6 to provide a through channel 16 between the vertical bars 6 and 14.

An elongated slip hitch member 18 is received in the through channel 16 for limited reciprocal movement relative to the upright bars 6 and 14 which form the side walls of the channel 16 when the lower edge 20 of the snow plow 4 contacts an item projecting upwardly from the ground causing the upper edge 22 of the snow plow to tip forwardly and upwardly in a limited arcuate path as the lower edge 20 is moved rearwardly and upwardly enough to clear the upwardly projecting item. The upright bars 6 and 14 then slide downwardly relative to the elongated slip hitch member 18 enabling the upper edge 22 and lower edge 20 of the snow plow 4 to move back to their original positions, the lower edge sliding downwardly and forwardly into scraping contact with the ground, the upper edge sliding downwardly and rearwardly in a slightly arcuate path.

The slip hitch member 18 includes a connecting hook member 24 formed at its upper end 26 facing rearwardly to receive the connecting lug 28 of a drive vehicle coupling assembly 30. The slip hitch member 18 includes an integrally formed upper flat planar section 32 extending downwardly about eighteen inches from the hook member 24. The slip hitch member 18 also includes a lower flat planar section 34 which extends another eight inches or so downward to terminate in a hitch member lower edge 36. A flat planar abutment member 38 is integrally formed to extend forwardly of the slip hitch member 18 and between the upper horizontal frame bar 8 and lower horizontal frame bar 10 of the snow plow 4 when the slip hitch connecting assembly and its slip hitch member 18 are in place on the snow plow 4.

The lower flat planar section 34 has an integrally formed connecting projection 40 extending rearwardly, having a connecting aperture 42 to receive the connecting pin of a drive vehicle coupling assembly 30. The elongated slip hitch member 18 is able to pivot slightly to the rear on the connecting pin in aperture 42 when the lower edge 20 of the snow plow encounters an obstacle on the ground. That in turn puts rearward pressure on the slip hitch member 18 causing it to pivot slightly to the rear as guide rod members connected to the snow plow slide upwardly and slightly to the rear in guide slots of the slip hitch member as the snow plow is moved rearwardly and upwardly to clear the obstacle. When the obstacle is cleared, the snow plow is free to fall back to its original position by gravity, causing the guide rod members to slide down in their respective guide slots of the slip hitch member to guide the snow plow to its original working position with its lower edge 20 in scraping contact with the ground to resume plowing snow.

The slip hitch member 18 includes an upper elongated guide slot 44 to receive an upper reciprocating guide rod or bolt 46 which extends across from the spaced apart upright bars 6 and 14 that are welded to the horizontal frame bars 8 and 10 of the snow plow frame 12 at the level of the upper frame bar 8. The slip hitch member 18 also includes a lower elongated guide slot 48 to receive a lower reciprocating guide rod or bolt 50 which extends across from the spaced apart upright bars 6 and 14 at the level of the lower horizontal frame bar 10. When the lower edge 20 of the snow plow 4 contacts an item projecting upwardly from the ground causing the upper edge 22 of the snow plow to tip forwardly and upwardly in a limited arcuate path as the lower edge 20 is moved rearwardly and upwardly enough to clear the upwardly projecting item, the guide bolts 46 and 50 move upwardly in their respective elongated guide slots 44 and 48. When the lower edge 20 of the snow plow has cleared the upwardly projecting item, the snow plow is then free to move downwardly by gravity to its original operating position whereby the guide bolts 46 and 50 move in a reciprocating manner downward in their respective guide slots 44 and 48.

The elongated slip hitch member 18 is able to pivot slightly to the rear on the connecting pin in aperture 42 when the lower edge 20 of the snow plow encounters an obstacle on the ground that in turn puts rearward pressure on the guide rods 46 and 50 in their respective guide slots 44 and 48 of the slip hitch member 18 causing it to pivot slightly to the rear as the guide rods slide upwardly and slightly to the rear in their guide slots 44 and 48 as the snow plow is moved rearwardly and upwardly to clear the obstacle.

I claim:

1. A slip hitch assembly for a snow plow having a snow plow frame, said slip hitch assembly comprising:

slip hitch support means for supporting an elongated slip hitch member thereon for limited reciprocal movement upwardly and downwardly relative thereto as said snow plow is moved upwardly and downwardly, including said elongated slip hitch member, said elongated slip hitch member mounted on said slip hitch support means for reciprocal movement upwardly and downwardly relative thereto as said snow plow moves upwardly and downwardly, said elongated slip hitch member including means for connection to a forward drive vehicle for moving said snow plow forward during its snow plowing operation;

said slip hitch support means consisting of a first slip hitch frame secured to said snow plow, said elongated slip hitch member mounted on said slip hitch support means for reciprocal movement upwardly and downwardly relative thereto as said snow plow moves upwardly and downwardly consisting of a first elongated slip hitch member being mounted for said reciprocal movement on said first slip hitch support frame, including a second slip hitch support frame secured to said snow plow frame at a location spaced apart horizontally from said first slip hitch support frame, a second elongated slip hitch member, said second elongated slip hitch member being mounted on said second slip hitch support frame for reciprocal movement upwardly and downwardly relative thereto as said snow plow moves upwardly and downwardly, said second elongated slip hitch member including connecting means for connection to said forward drive vehicle for moving said snow plow forward during its snow plowing operation; and said reciprocally movable first elongated slip hitch member including an upper end and a lower end, a hook member at its upper end facing rearwardly for connection to said forward drive vehicle, an upper flat planar section of first elongated slip hitch member extending downwardly therefrom to terminate at said lower end of said first elongated slip hitch member, an elongated upper guide slot provided through said upper flat planar section, an elongated lower guide slot provided through said lower flat planar section, an integrally formed flat planar forward projecting section of said first elongated slip hitch member extending forwardly thereof at a location between said upper and lower guide slots, an integrally formed flat planar rearward projecting section of said first elongated slip hitch member extending rearwardly thereof at its said lower end, and an aperture through said flat planar rearward projecting section.

2. A slip hitch assembly for a snow plow having a snow plow frame as set forth in claim 1 wherein said snow plow frame includes an upper horizontal frame bar and a lower horizontal frame bar spaced apart downwardly therefrom, said slip hitch support means includes a first vertically extending upright bar member, a second vertically extending upright bar member spaced apart slightly from said first upright bar member, a receiving channel between said first and second upright bar members to receive said first elongated slip hitch member therein for reciprocal movement therein.

3. A slip hitch assembly for a snow plow having a snow plow frame as set forth in claim 2, including a first laterally extending guide bolt secured between said first and second vertically extending upright bar members at a location substantially even with said upper horizontal frame bar of said snow plow frame for reception of said first guide bolt in said upper guide slot when said first elongated slip hitch member is received in said receiving channel, a second laterally extending guide bolt secured between said first and second vertically extending upright bar members at a location substantially even with said lower horizontal frame bar of said snow plow frame for reception of said second guide bolt in said lower guide slot when said first elongated slip hitch member is received in said receiving channel.

4. A slip hitch assembly for a snow plow having a snow plow frame as set forth in claim 2, including a first laterally extending guide bolt secured between said first and second vertically extending upright bar members at a location substantially even with said upper horizontal frame bar of said snow plow frame, said first guide bolt being received in said upper guide slot of said first elongated slip hitch member received in said receiving channel for reciprocal movement therein, a second laterally extending guide bolt secured between said first and second vertically extending upright bar members at a location substantially even with said lower horizontal frame bar of said snow plow frame, said second guide bolt being received in said lower guide slot of said first elongated slip hitch member received in said receiving channel.

5. A slip hitch assembly for a snow plow having a snow plow frame as set forth in claim 2, including a first laterally extending guide bolt secured between said first and second vertically extending upright bar members at a location substantially even with said upper horizontal frame bar of said snow plow frame, said first guide bolt being received in said upper guide slot of said first elongated slip hitch member received in said receiving channel for reciprocal movement therein, a second laterally extending guide bolt secured between said first and second vertically extending upright bar members at a location substantially even with said lower horizontal frame bar of said snow plow frame, said second guide bolt being received in said lower guide slot of said first elongated slip hitch member received in said receiving channel, said integrally formed flat planar forward projecting section of said first elongated slip hitch member extending forwardly thereof at a location between said upper and lower horizontal frame bars of said snow plow frame with said upper horizontal bar above said flat planar forward projecting section and said lower horizontal bar below said flat planar forward projecting section of said first elongated slip hitch member received in said receiving channel.

6. A slip hitch assembly for a snow plow having a snow plow frame as set forth in claim 1, wherein said reciprocally movable second elongated slip hitch member includes an upper end and lower end, a hook member at its upper end for connection to said forward drive vehicle, an extended section of said second elongated slip hitch member extending downwardly from said upper end, an elongated guide slot provided through said extended section, an integrally formed rearward projecting section of said first elongated slip hitch member extending rearwardly thereof at its said lower end, and a pivot aperture through said flat planar rearward projecting section for pivotal connection of said lower end of said slip hitch member to said forward drive vehicle, including a laterally extending guide rod secured to said snow plow frame positioned for connection to said second elongated slip hitch member, said laterally extending guide rod received in said guide slot of said slip hitch member.

* * * * *